US008597037B2

(12) United States Patent
Halim et al.

(10) Patent No.: US 8,597,037 B2
(45) Date of Patent: Dec. 3, 2013

(54) SOCKET AND A SYSTEM OF CASCADABLE SOCKETS

(75) Inventors: Temy Sanjaya Halim, Singapore (SG); Chee Yeong Ya, Singapore (SG)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 13/312,229

(22) Filed: Dec. 6, 2011

(65) Prior Publication Data

US 2012/0149247 A1 Jun. 14, 2012

(30) Foreign Application Priority Data

Dec. 8, 2010 (SG) ..... 201009100-7

(51) Int. Cl.
*H01R 13/44* (2006.01)

(52) U.S. Cl.
USPC ..... 439/141; 439/717

(58) Field of Classification Search
USPC ..... 439/141, 717, 928
See application file for complete search history.

(56) References Cited

U.S. PATENT DOCUMENTS

| | | | | |
|---|---|---|---|---|
| 4,322,120 | A * | 3/1982 | Rilling | 439/631 |
| 5,885,109 | A * | 3/1999 | Lee et al. | 439/652 |
| 6,634,910 | B2 * | 10/2003 | Lieb et al. | 439/715 |
| 7,021,974 | B2 * | 4/2006 | Sichner et al. | 439/717 |
| 7,125,265 | B2 * | 10/2006 | Weng | 439/131 |
| 7,896,711 | B2 * | 3/2011 | De Carolis et al. | 439/717 |
| 8,052,438 | B1 * | 11/2011 | Hung | 439/131 |
| 8,074,680 | B2 * | 12/2011 | De Carolis et al. | 137/560 |
| 8,256,456 | B2 * | 9/2012 | De Carolis et al. | 137/560 |

* cited by examiner

*Primary Examiner* — Gary Paumen
(74) *Attorney, Agent, or Firm* — Frommer Lawrence & Haug LLP; David V. Rossi

(57) ABSTRACT

The present invention relates to a socket and a system of cascadable sockets for insertion therein of electrical devices such as relays, timers or counters. The socket includes device connection means by which an electrical device may be electrically connected to the socket, and may further include terminals providing electrical contacts for connecting the electrical device to an external electrical signal or a circuit. The socket includes socket connection means, for example, in the form of a slidable connector for engaging another socket placed against it. Two or more sockets engaged in this manner may facilitate a parallel electrical connection between the electrical devices each inserted in one of the two or more sockets.

27 Claims, 7 Drawing Sheets

SOCKET AND A SYSTEM OF CASCADABLE SOCKETS

CROSS-REFERENCE TO RELATED APPLICATIONS

This application is based upon and claims the benefit of priority from the corresponding Singapore Patent Application No. 201009100-7, filed Dec. 8, 2010, which is incorporated herein by reference in its entirety.

TECHNICAL FIELD

The present disclosure relates generally to a socket for electrical devices, and particularly to a cascadable electrical socket.

BACKGROUND

In constructing an electrical circuit, certain types of electrical devices such as relays, timers and counters are often connected to the circuit via sockets, acting as intermediary components between the electrical devices and the rest of the circuit. Using sockets to connect devices in a circuit facilitates the removal and addition of electrical devices within the circuit, such as when upgrading to an electrical device of a different power rating or when replacing a defective electrical device.

A socket typically includes socket terminals such as leads or wires for electrical connection to other components in the circuit. In practice, an electrical device may first be inserted in an appropriate socket. Internal electronics or circuitry of the socket may enable electrical connection of the inserted device to the socket terminals, which in turn are appropriately connected to an external circuit, so that the inserted device is electrically connected to the external circuit. The sockets may be appropriately fastened, for example by screws, to an appropriate support surface such as a circuit board.

In some cases, it may be necessary for a number of electrical devices inserted in nearby sockets to share a single voltage signal or voltage source. Over the past this has been achieved by using additional wires or jumpers between terminals of different sockets so that the devices are connected in parallel to one another, and therefore connected in parallel to the same voltage signal or voltage source. Installing additional wires or jumpers to connect a large number of electrical devices in parallel may be time-consuming or prone to errors. Similarly, disconnecting electrical devices from the parallel circuit may also be time-consuming.

SUMMARY

According to a first aspect of some embodiments of the invention there is provided a first socket comprising:

first device connection means for providing electrical connect ion between the first socket and a first electrical device; and first socket connection means being electrically coupled to the first device connection means and configured to move between a disconnect position and a connect position, wherein the first socket connection means upon being moved to its connect position is adapted to provide electrical connection between the first socket and a second socket, the second socket including second device connection means for providing electrical connection between the second socket and a second electrical device, to facilitate electrical connection between the first electrical device and the second electrical device in parallel.

Preferably the first socket connection means includes a slidable connector for slidably moving the first socket connection means between the connect position and the disconnect position. More preferably the slidable connector, upon moving the first socket connection means to its connect position, extends beyond a first housing of the first socket into a second housing of the second socket. Even more preferably the slidable connector, upon extending into the second housing of the second socket, connects the first socket to the second socket.

Preferably the slidable connector is adapted to electrically disconnect the first socket from the second socket. More preferably the slidable connector, upon moving the first socket connection means to its disconnect position, withdraws into the first housing of the first socket. Even more preferably the slidable connector, upon withdrawing into the first housing of the first socket, disconnects the first socket from the second socket.

Preferably the slidable connector includes a first female connector for engaging a second male connector of the second socket upon moving the first socket connection means to its connect position. More preferably the first female connector includes two receptacles for respectively receiving two inserts of the second male connector. Even more preferably the two receptacles are adapted for electrical connection to a positive terminal and a negative terminal, respectively, of the first electrical device. Still more preferably the two inserts are adapted for electrical connection to a positive terminal and a negative terminal, respectively, of the second electrical device.

Preferably the two receptacles are each in the form of a hollow cylinder for receiving a respective one of the two inserts each in the form of a pin. More preferably the hollow cylinder includes a slit running longitudinally for facilitating insertion of the pin into the hollow cylinder. Even more preferably the slit allows for an increased diameter or circumference of the hollow cylinder upon insertion of the pin.

Preferably the slidable connector includes a switch or handle for slidably moving the first socket connection means between the disconnect position and the connect position.

Preferably the first socket, upon moving the socket connection means to its disconnect position, is electrically disconnected from the second electrical socket.

Preferably the second socket includes second socket connection means being electrically coupled to the second device connection means and configured to move between a disconnect position and a connect position, wherein the second socket connection means in its connect position is adapted to provide an electrical connection between the second socket and a third socket, which includes third device connection means for providing an electrical connection between the third socket and a third electrical device, to facilitate electrical connection between the second electrical device and the third electrical device in parallel.

Preferably the slidable connector is slidably and electrically coupled to a bridging connector of the first socket. More preferably the bridging connector is electrically coupled to a first male connector of the first socket. Even more preferably the first male connector is adapted to engage a fourth female connector of a fourth socket.

Preferably the slidable connector is substantially within the first housing and/or the second housing. More preferably the socket connection means is substantially within first the housing and/or the second housing.

Preferably the first electrical device includes a relay, a timer or a counter.

Preferably the second electrical device includes a relay, a timer or a counter.

Preferably the third electrical device includes a relay, a timer or a counter.

Preferably the first socket further comprises a visual indicator for indicating a position of the socket connection means. More preferably the indicator includes a visual indicator.

According to a second aspect of some embodiments of the invention there is provided a system of cascadable sockets for electrically connecting electrical devices in parallel comprising:

a first socket including:

first device connection means for providing electrical connection between the first socket and a first electrical device; and first socket connection means being electrically coupled to the first device connection means and configured to move between a disconnect position and a connect position; and a second socket including:

second device connection means for providing electrical connection between the second socket and a second electrical device; and second socket connection means being electrically coupled to the second device connection means and configured to move between a disconnect position and a connect position, wherein the first socket connection means and the second socket connection means upon being moved to their connect positions are adapted to provide electrical connection among the first socket, the second socket and a third socket, the third socket including third device connection means for providing electrical connection between the third socket and a third electrical device, to facilitate electrical connection among the first electrical device, the second electrical device and the third electrical device in parallel.

It is understood that the foregoing summary is representative of some embodiments of the invention, and is neither representative nor inclusive of all subject matter and embodiments within the scope of the present invention. It is further understood that in the foregoing summary references to various features being preferable and/or being comparatively preferable (e.g., more preferably, even more preferably, etc.) are applicable to various embodiments or implementations and do not imply that such preferences and/or comparative preferences are applicable to all embodiments, and thus should not be limiting or restrictive of the present invention as claimed. Additionally, it will be appreciated by those skilled in the art that the foregoing brief description and the following detailed description are exemplary and explanatory of some embodiments of the present invention, but are not intended to be restrictive of the present invention or limiting of the advantages which it can achieve in various implementations.

BRIEF DESCRIPTION OF THE DRAWINGS

Aspects, features, and advantages of some embodiments of the invention, both as to structure and operation, will be understood and will become more readily apparent when the invention is considered in the light of the following description made in conjunction with the accompanying drawings, in which like reference numerals designate the same or similar parts throughout the various figures, and wherein.

DETAILED DESCRIPTION

Figure 1:
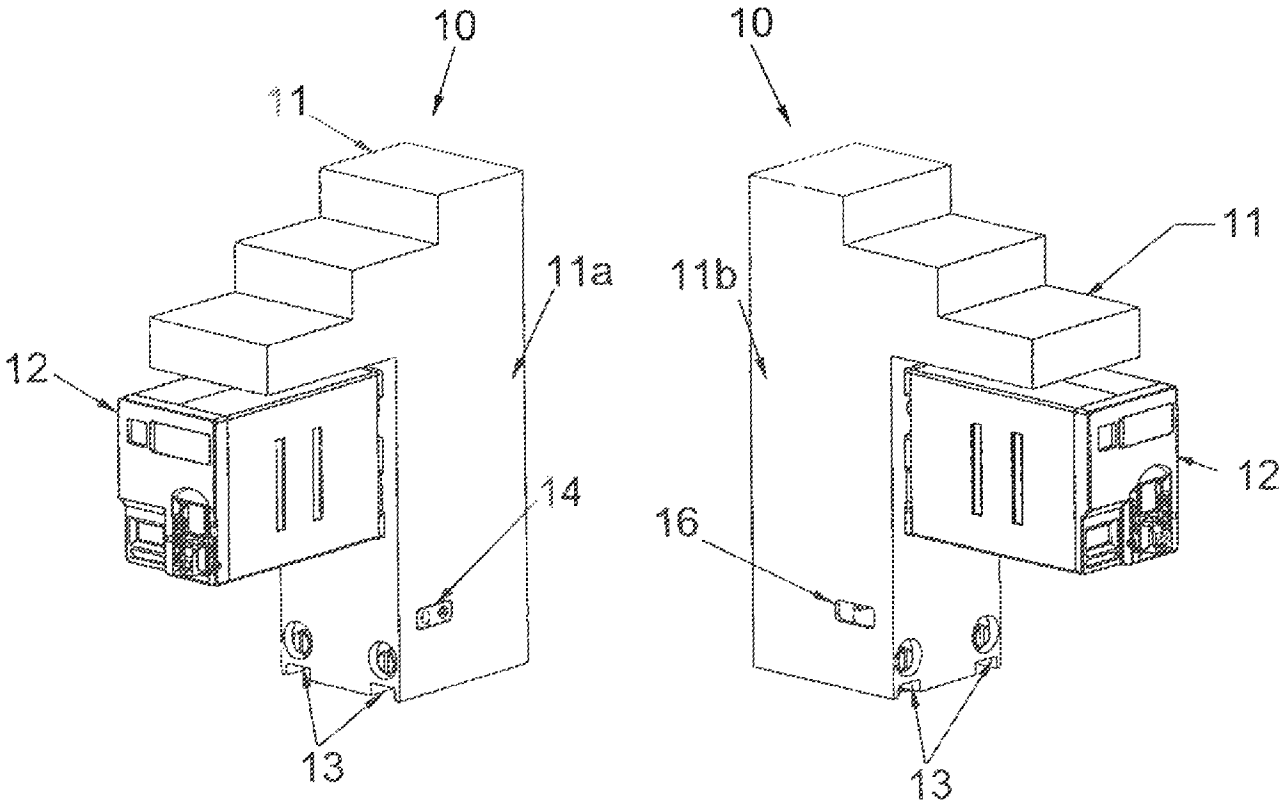
FIG. 1 illustrates two perspective views of a socket in accordance with an embodiment of the present invention.

Embodiments of the present invention relate to a socket and a system of cascadable sockets for insertion therein of electrical devices such as relays, timers or counters. FIG. 1 shows a socket 10 in two different perspective views in accordance with an embodiment of the invention. The socket 10 has a housing 11, which may be made of plastic, for providing electrical isolation of internal electronics or circuitry, of the socket 10 from the surroundings. The socket 10 includes device connection means (not shown) by which an electrical device 12 may be electrically connected to the socket 10. For example, in this embodiment, the socket 10 is a relay socket and a relay 12 is shown to be inserted into the socket 10. The relay 12 may be a four-pin relay, and the device connection means may be four pin-receiving slots for receiving the four pins of the relay 12. The socket 10 may include two terminals 13, which provide electrical contacts for connecting the electrical device 12 to an external electrical signal or a circuit. The socket 10 includes socket connection means 14 for engaging a receiving port of another socket (not shown) placed against one side 11*a* of the socket 10. The socket 10 may itself include a receiving port 16 for receiving socket connection means of yet another socket (not shown) placed against an opposite side 11*b* of the socket 10.

Figure 2A:
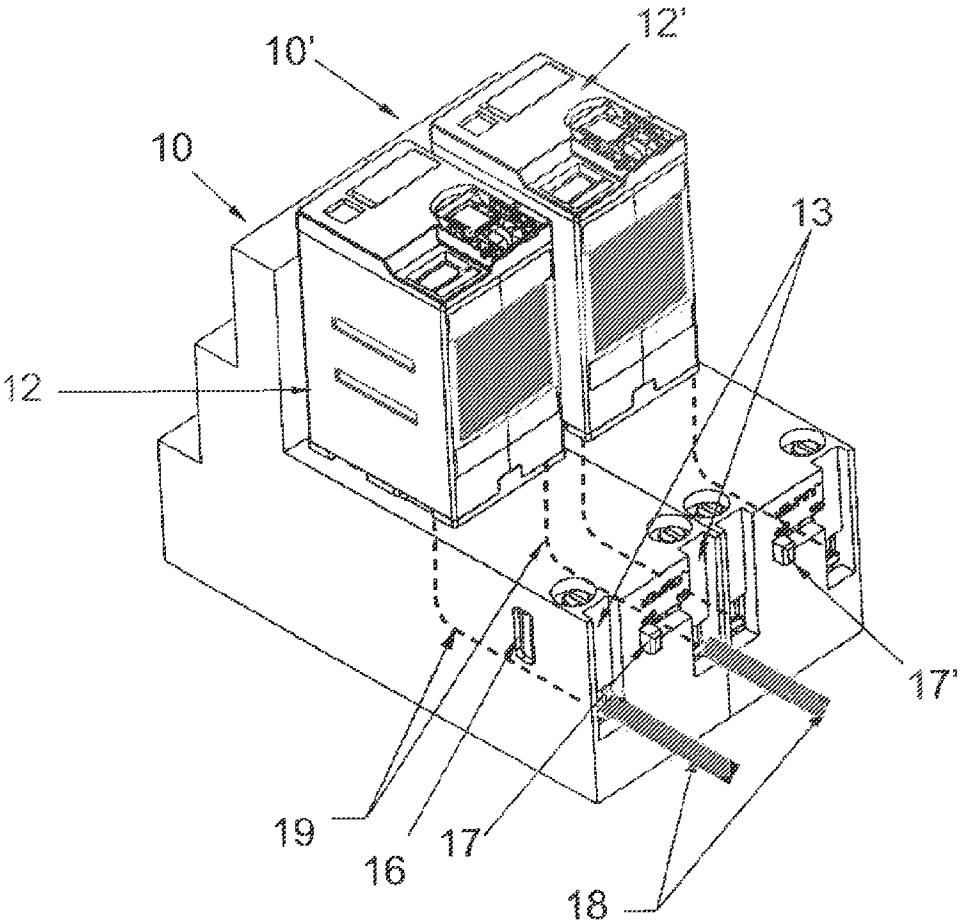
FIG. 2A is a perspective view of two sockets, one of which being moved in a disconnect position, in accordance with the embodiment shown in FIG. 1.

FIGS. 2A and 28 show the socket 10 (hereinafter first socket) being placed side-by-side with an identical socket 10' (hereinafter second socket). The terminals 13 of the first socket 10 are shown to be in contact with two conductors, leads or wires 18 which may be connected to an external electrical signal or a circuit. The terminals 13 are in turn connected to the inserted device 12 via internal electronics or circuitry 19. The socket connection means 14 (not shown) can be biased or moved, for example via a switch or a handle 17, between a disconnect position and a connect position by sliding a slidable connector (described further below). FIG. 2A shows that the socket connection means 14 is in the disconnect position whereas FIG. 2B shows that the socket connection means 14 is in the connect position.

Figure 2B:
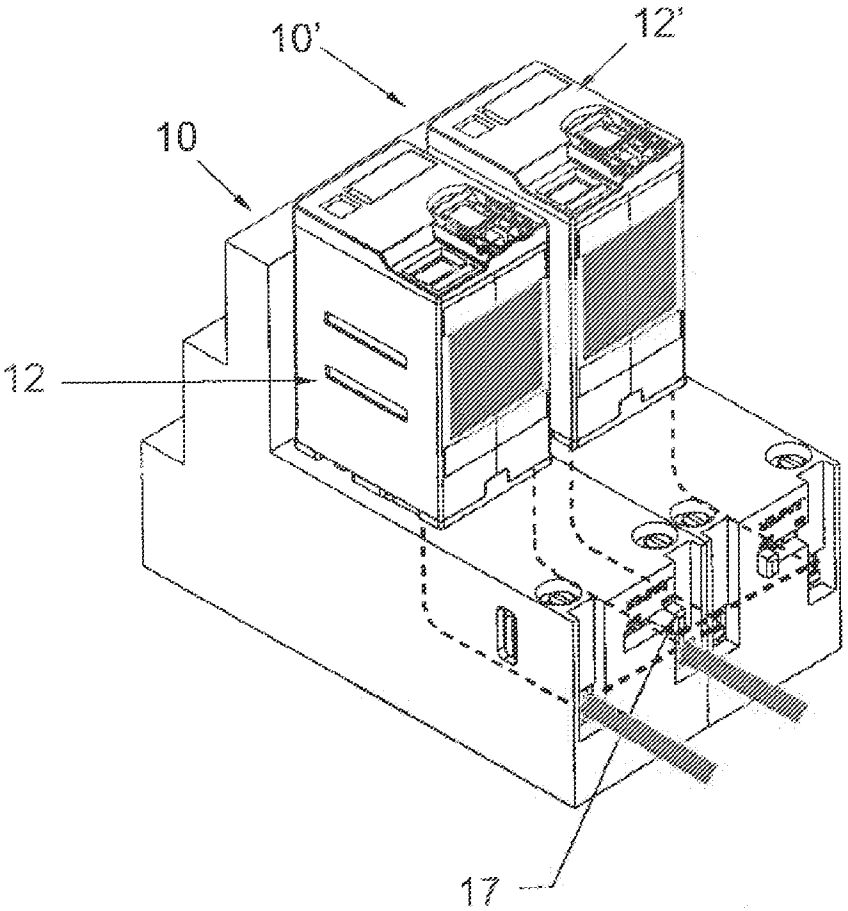
FIG. 2B is a perspective view of two sockets, one of which being moved in a connect position, in accordance with the embodiment shown in FIG. 1.
Figure 3A:
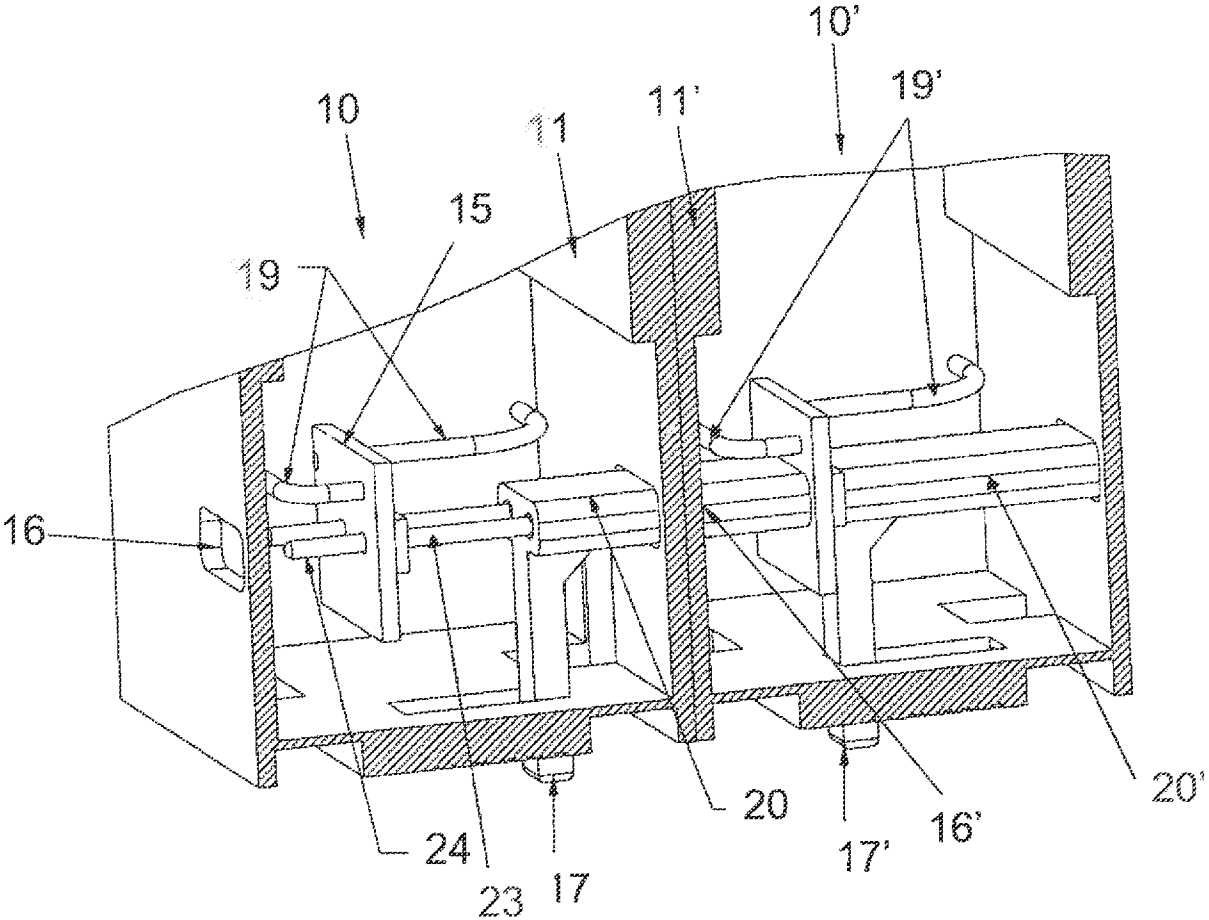
FIG. 3A is an internal perspective view of the two sockets shown in FIG. 28.
Figure 3B:
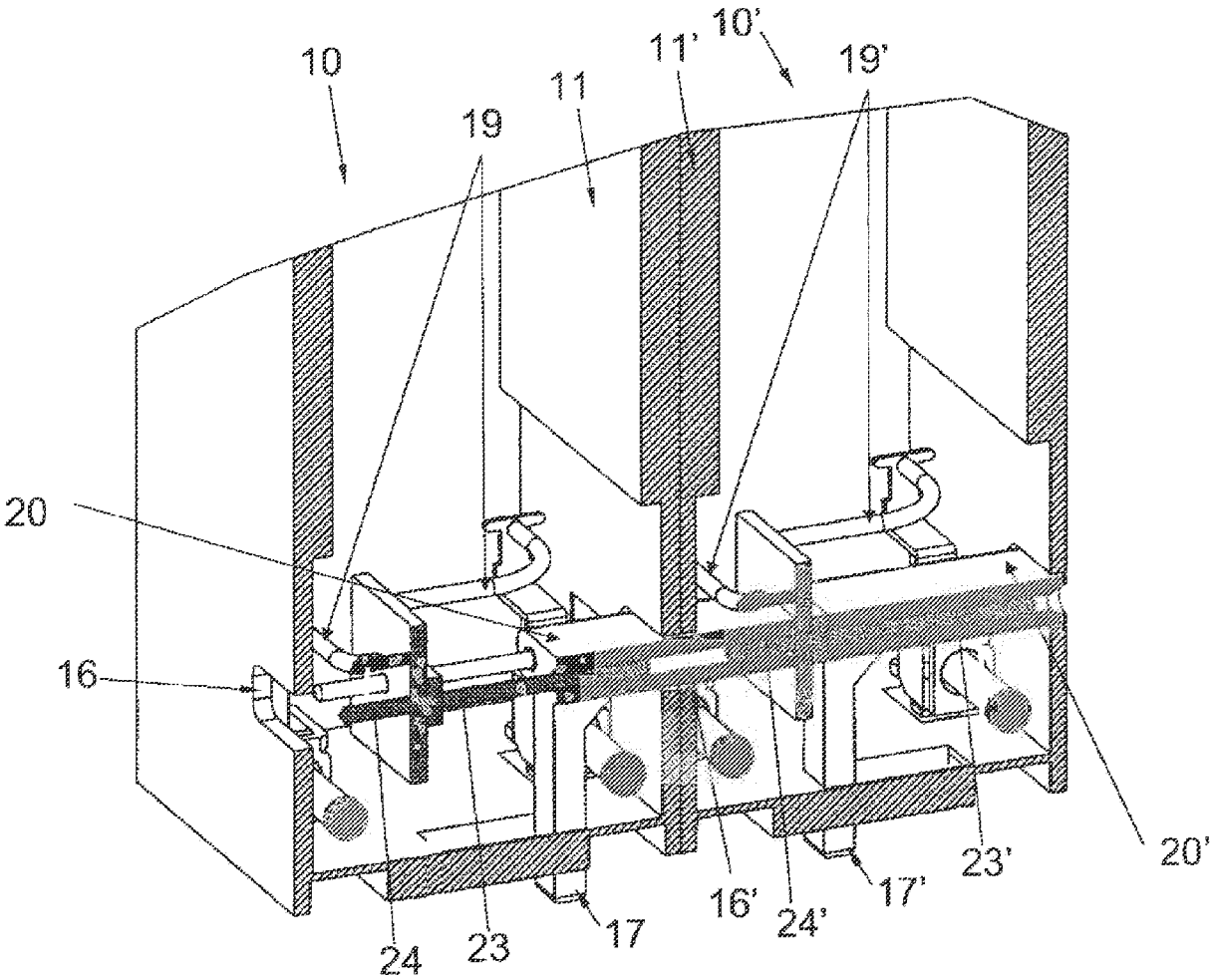
FIG. 3B is a cut-away view of the two sockets shown in FIG. 3A.

FIG. 3A shows a partial internal view of the two sockets 10 and 10' as shown in FIG. 2B illustrating the socket connection means 14 moved to its connect position. FIG. 3B shows a similar cut-away view. The socket connection means 14 of the first socket 10 includes a slidable connector 20 for electrically connecting/disconnecting the first socket 10 to/from the second socket 10'. As shown, the slidable connector 20 may slide and extend beyond one side 11*a* of the housing 11 of the first socket into the second socket 10' by, for example, sliding the switch or handle 17. When extended into the second socket 10', the first socket connection means 14 is in the connect position and the slidable connector 20 electrically connects the first socket 10 to the second socket 10'. Internal electronics or circuitry 19 and 19' of the first socket and the second socket then facilitate an electrical connection between the inserted devices 12 and 12' in parallel. Although not shown in FIG. 3, the slidable connector 20 may slide and withdraw into the housing 11 and electrically disconnects the first socket 10 from the second socket 10'. Similarly, the socket connection means 14' of the second socket 10' includes a slidable connector 20' for electrically connecting/disconnecting the second socket 10' to/from a third socket (not shown).

In contrast to the conventional way where external jumpers and wires are used to connect nearby sockets in parallel, the slidable connector is substantially built within each socket.

Figure 4:
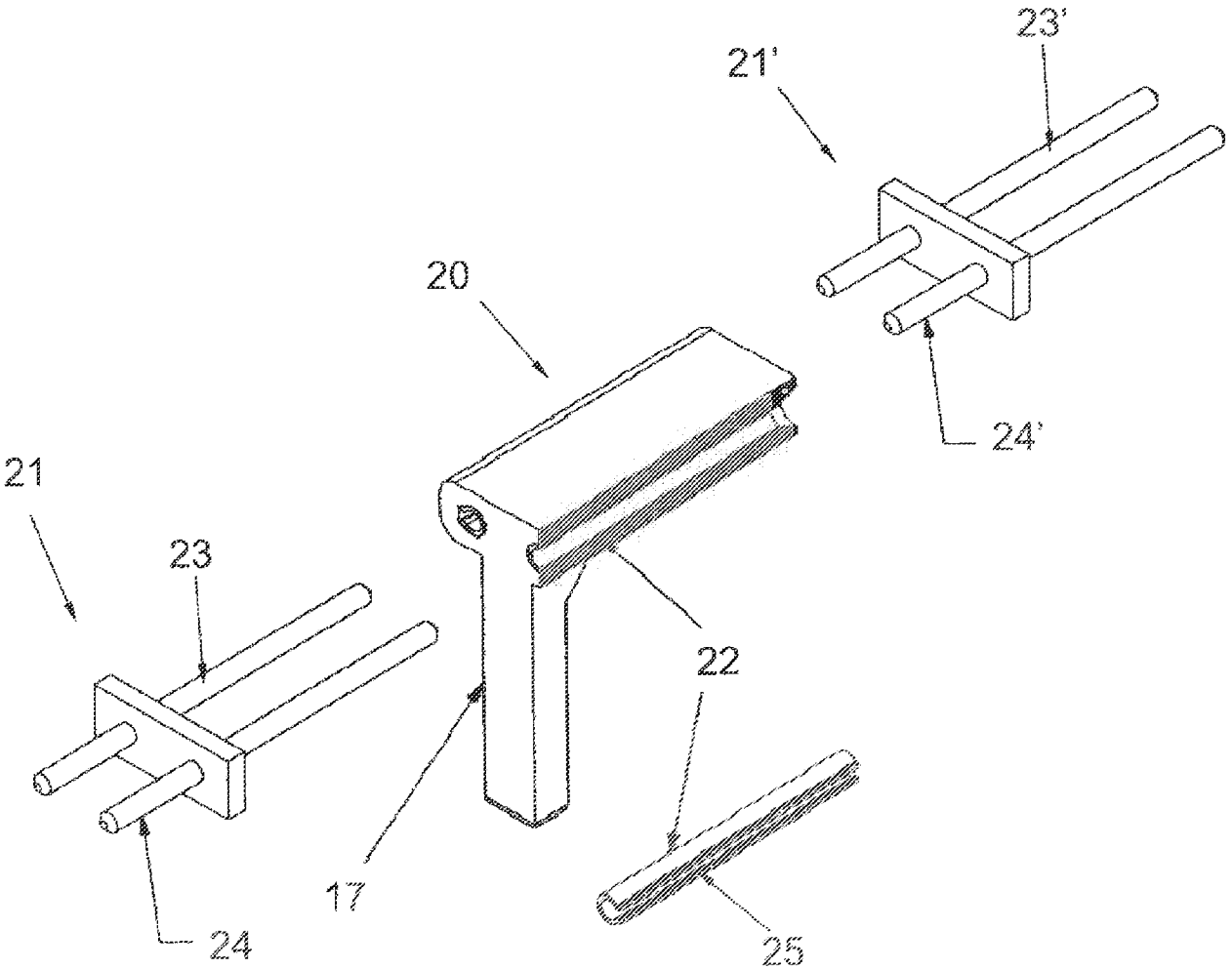
FIG. 4 shows perspective views of a header of a first socket, a slidable connector of the first socket and a header of the second socket, in accordance with some embodiments of the present invention.

As shown in FIG. 4, the slidable connector 20 may include a female connector 22, which in this embodiment is a pair of receptacles in the form of a pair of hollow cylinders open at both ends. The hollow cylinders may be encased in a plastic mould for electrical isolation from the surroundings. In this embodiment, the hollow cylinders may be slidably coupled to a header 21, which comprises a bridging connector 23 and a male connector 24 (see also FIG. 3). The header 21 is electrically coupled to the internal electronics or circuitry 19, so that regardless of the position of the first socket connection means 14, the pair of receptacles are electrically connected to a positive terminal and a negative terminal, respectively, of the inserted device 12. The bridging connector 23 may be formed integrally with the male connector 24, which in this embodiment is a pair of inserts in the form of a pair of pins.

Being identical to the first socket, the second socket 10' may also include a header 21' comprising a bridging connector 23' and an integrated male connector 24' in the form of a pair of pins similar to the bridging connector 23 and the male connector 24 of the first socket 10. The female connector 22 of the first socket 10 is designed to engage the male connector 24' of the second socket 10'. The pair of pins of the second socket 10' are electrically connected to a positive terminal and a negative terminal, respectively, of the inserted device 12'. Upon moving the first socket connection means 14 to its connect position (that is, sliding the slidable connector 20 beyond the housing 11 of the first socket 10 into the housing 11' of the second socket 10'), the two receptacles of the first socket 10 may respectively receive the two inserts of the male connector 24', thereby facilitating an electrical connection between the two inserted devices 12 and 12' in parallel. Similarly, if a fourth socket is placed against an opposed side 11*b* of the first socket 10 (see FIG. 1), the male connecter 24 of the first socket 10 may engage socket connection means of the fourth socket.

The hollow cylinders may each be resilient and have a slit 25 running longitudinally. The slit 25 allows for expansion or an increased diameter or circumference of the hollow cylinder upon insertion of the pin of the male connector 24' into the hollow cylinder. The resilience of the expanded hollow cylinder may therefore assist in gripping the inserted pin to maintain adequate electrical contact and connection between the female connector 22 and the male connector 24'.

Figure 5:
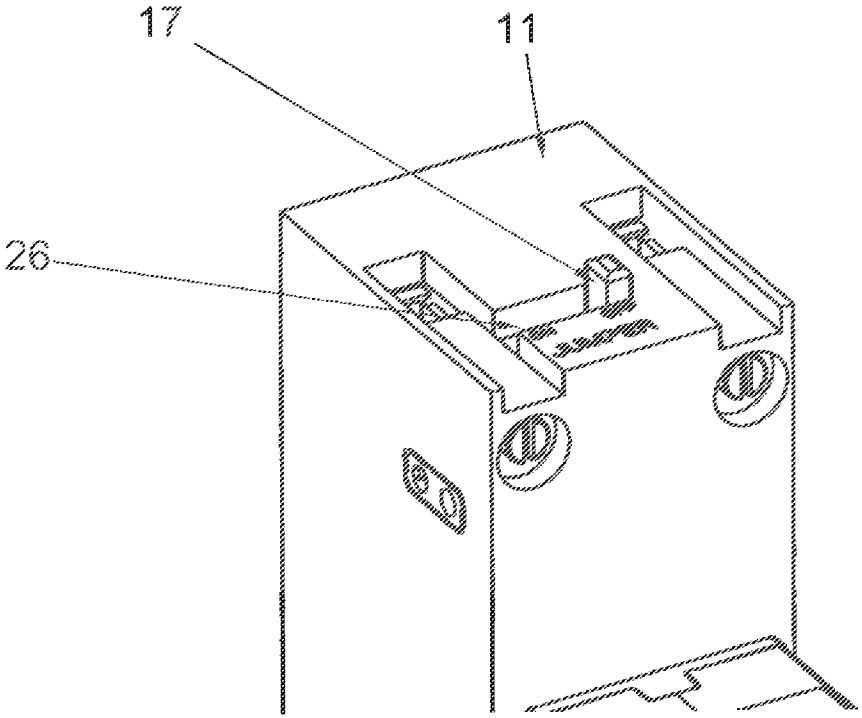
FIG. 5 is a partial perspective view of a socket in accordance with the embodiment shown in FIG. 1.

FIG. 5 shows that the switch or the handle 17, together with markings 26 such as ON and OFF or CONNECT and DISCONNECT on the housing 11, may conveniently act as an indicator for indicating a position (for example, the connect position, the disconnect position or any position in between) of the socket connection means 14. The slidable connector 20 therefore provides a substantially built-in or internal means of electrical connection between two sockets while facilitating a visual indication as to whether the two sockets are electrically connected.

It should be apparent from the above description that a series of sockets in accordance with the present invention are cascadable in parallel electrical connection by aligning the socket connection means of each socket to a receiving port of a next socket. In this cascaded configuration, each of the sockets may be independently connected to or disconnected from the next socket by moving its socket connection means between the connect position and disconnect position.

Having described an embodiment of the socket, it should be apparent that various embodiments of the invention may have one or more of the following advantages:

- Manual wiring of jumpers is not necessary to connect/disconnect nearby sockets in parallel
- Parallel electrical connection/disconnect can be made by sliding the switch or handle.
- An internal or built-in arrangement of the socket eliminates messy wires or jumpers.
- A visual indication is provided to show whether the slidable connector of a socket is electrically connected to or disconnected from a next socket.

It will be understood, however, that the present invention may be practiced without necessarily providing one or more of the advantages described herein or otherwise understood in view of the disclosure and/or that may be realized in some embodiments thereof. It will be appreciated by persons skilled in the art that numerous variations and/or modifications may be made to the invention as shown in the specific embodiment without departing from the spirit or scope of the invention as broadly described. For example, there may be more than two sockets in a cascaded configuration. The slidable connector may include a male connector instead of a female connector, and the header may include a female connector instead of a male connector. The present embodiments are, therefore, to be considered in all respects as illustrative and not restrictive of the present invention, which should be defined in accordance with the claims that follow.

What is claimed is:

1. A first socket comprising:

first device connection means for providing electrical connection between the first socket and a first electrical device; and first socket connection means being electrically coupled to the first device connection means and configured to move between a disconnect position and a connect position, wherein the first socket connection means upon being moved to its connect position is adapted to provide electrical connection between the first socket and a second socket, the second socket including second device connection means for providing electrical connection between the second socket and a second electrical device, to facilitate electrical connection between the first electrical device and the second electrical device in parallel, and wherein the first socket connection means includes a slidable connector for slidably moving the first socket connection means between the connect position and the disconnect position.

2. The first socket as claimed in claim 1 wherein the slidable connector, upon moving the first socket connection means to its connect position, extends beyond a first housing of the first socket into a second housing of the second socket.

3. The first socket as claimed in claim 2 wherein the slidable connector, upon extending into the second housing of the second socket, connects the first socket to the second socket.

4. The first socket as claimed in claim 1, wherein the slidable connector is adapted to electrically disconnect the first socket from the second socket.

5. The first socket as claimed in claim 4 wherein the slidable connector, upon moving the first socket connection means to its disconnect position, withdraws into the first housing of the first socket.

6. The first socket as claimed in claim 5 wherein the slidable connector, upon withdrawing into the first housing of the first socket, disconnects the first socket from the second socket.

7. The first socket as claimed in claim 1, wherein the slidable connector includes a first female connector for engaging a second male connector of the second socket upon moving the first socket connection means to its connect position.

8. The first socket as claimed in claim 7 wherein the first female connector includes two receptacles for respectively receiving two inserts of the second male connector.

9. The first socket as claimed in claim 8 wherein the two receptacles are adapted for electrical connection to a positive terminal and a negative terminal, respectively, of the first electrical device.

10. The first socket as claimed in claim 9 wherein the two inserts are adapted for electrical connection to a positive terminal and a negative terminal, respectively, of the second electrical device.

11. The first socket as claimed in claim 8, wherein the two receptacles are each in the form of a hollow cylinder for receiving a respective one of the two inserts each in the form of a pin.

12. The first socket as claimed in claim 11 wherein the hollow cylinder includes a slit running longitudinally for facilitating insertion of the pin into the hollow cylinder.

13. The first socket as claimed in claim 12 wherein the slit allows for an increased diameter or circumference of the hollow cylinder upon insertion of the pin.

14. The first socket as claimed in claim 1, wherein the slidable connector includes a switch or handle for slidably moving the first socket connection means between the disconnect position and the connect position.

15. The first socket as claimed in claim 1, wherein the slidable connector is slidably and electrically coupled to a bridging connector of the first socket.

16. The first socket as claimed in claim 15 wherein the bridging connector is electrically coupled to a first male connector of the first socket.

17. The first socket as claimed in claim 16 wherein the first male connector is adapted to engage a fourth female connector of a fourth socket.

18. The first socket as claimed in claim 1, wherein the slidable connector is substantially within the first housing and/or the second housing.

19. The first socket as claimed in claim 1, wherein the socket connection means is substantially within first the housing and/or the second housing.

20. The first socket as claimed in claim 1, wherein the first electrical device includes a relay, a timer or a counter.

21. The first socket as claimed in claim 1, wherein the second electrical device includes a relay, a timer or a counter.

22. The first socket as claimed in claim 1, wherein the third electrical device includes a relay, a timer or a counter.

23. The first socket as claimed in claim 1, further comprising an indicator for indicating a position of the socket connection means.

24. The first socket as claimed in claim 23 wherein the indicator includes a visual indicator.

25. A first socket comprising:

first device connection means for providing electrical connection between the first socket and a first electrical device; and first socket connection means being electrically coupled to the first device connection means and configured to move between a disconnect position and a connect position, wherein the first socket connection means upon being moved to its connect position is adapted to provide electrical connection between the first socket and a second socket, the second socket including second device connection means for providing electrical connection between the second socket and a second electrical device, to facilitate electrical connection between the first electrical device and the second electrical device in parallel, and wherein the first socket, upon moving the socket connection means to its disconnect position, is electrically disconnected from the second electrical socket.

26. A first socket comprising:

first device connection means for providing electrical connection between the first socket and a first electrical device; and first socket connection means being electrically coupled to the first device connection means and configured to move between a disconnect position and a connect position, wherein the first socket connection means upon being moved to its connect position is adapted to provide electrical connection between the first socket and a second socket, the second socket including second device connection means for providing electrical connection between the second socket and a second electrical device, to facilitate electrical connection between the first electrical device and the second electrical device in parallel, and wherein the second socket includes second socket connection means being electrically coupled to the second device connection means and configured to move between a disconnect position and a connect position, wherein the second socket connection means in its connect position is adapted to provide an electrical connection between the second socket and a third socket, which includes third device connection means for providing an electrical connection between the third socket and a third electrical device, to facilitate electrical connection between the second electrical device and the third electrical device in parallel.

27. A system of cascadable sockets for electrically connecting electrical devices in parallel comprising:

a first socket including:

first device connection means for providing electrical connection between the first socket and a first electrical device; and first socket connection means being electrically coupled to the first device connection means and configured to move between a disconnect position and a connect position; and a second socket including:

second device connection means for providing electrical connection between the second socket and a second electrical device; and second socket connection means being electrically coupled to the second device connection means and configured to move between a disconnect position and a connect position, wherein the first socket connection means and the second socket connection means upon being moved to their connect positions are adapted to provide electrical connection among the first socket, the second socket and a third socket, the third socket including third device connection means for providing electrical connection between the third socket and a third electrical device, to facilitate electrical connection among the first electrical device, the second electrical device and the third electrical device in parallel.

* * * * *